US010505278B2

(12) United States Patent
Cobos Reyes et al.

(10) Patent No.: US 10,505,278 B2
(45) Date of Patent: Dec. 10, 2019

(54) THREE-AXIS ANTENNA WITH IMPROVED QUALITY FACTOR

(71) Applicant: PREMO, S.L., Campanillas (ES)

(72) Inventors: Sergio Cobos Reyes, Málaga (ES); Francisco Ezequiel Navarro Pérez, Bobadilla Estación Antequera (ES); Antonio Rojas Cuevas, Málaga (ES)

(73) Assignee: PREMO S.A., Campanillas (ES)

( * ) Notice: Subject to any disclaimer, the term of this patent is extended or adjusted under 35 U.S.C. 154(b) by 0 days.

(21) Appl. No.: 16/037,343

(22) Filed: Jul. 17, 2018

(65) Prior Publication Data

US 2019/0027828 A1 Jan. 24, 2019

(30) Foreign Application Priority Data

Jul. 18, 2017 (EP) ..... 17382468

(51) Int. Cl.
*H01Q 7/08* (2006.01)
*H01Q 1/38* (2006.01)
(Continued)

(52) U.S. Cl.
CPC ..... *H01Q 7/08* (2013.01); *H01Q 1/38* (2013.01); *H01Q 7/06* (2013.01); *H01F 2003/005* (2013.01); *H01Q 1/40* (2013.01)

(58) Field of Classification Search
CPC .. H01Q 7/08; H01Q 1/38; H01Q 7/06; H01Q 1/40; H01Q 1/3241; H01F 2003/005
See application file for complete search history.

(56) References Cited

U.S. PATENT DOCUMENTS 5,966,641 A 10/1999 Flowerdew
6,407,677 B1 6/2002 Avenel et al.
(Continued)

FOREIGN PATENT DOCUMENTS

EP 1526606 4/2005
EP 23670704 8/2011
(Continued)

OTHER PUBLICATIONS

European Priority Search Report dated Jan. 29, 2018 for European Priority Application No. 17382468.1.

*Primary Examiner* — Dameon E Levi
*Assistant Examiner* — David E Lotter
(74) *Attorney, Agent, or Firm* — Silvia Salvadori

(57) ABSTRACT

Three-axis antenna comprising a magnetic core (10) including protuberances (11) on each corner delimiting an X-axis winding channel (12X) and a Y-axis winding channel (12Y); in X-axis coil (20X) within the X-axis winding channel (12X), comprising two separate and adjacent X-axis partial coils (21X); a Y-axis coil (20Y) within the Y-axis winding channel (12Y), comprising two separate and adjacent Y-axis partial coils (21Y); and a Z-axis coil (20Z) surrounding the magnetic core (10), wherein said magnetic core includes at least one X-axis partition wall (14X) dividing the X-axis winding channel (12X) in two X-axis partial winding channels (13X) wherein the two separate and adjacent Y-axis partial coils (21Y) are housed, and at least one Y-axis partition wall (14Y) dividing the Y-axis winding channel (12Y) in two Y-axis partial winding channels (13Y) wherein the two separate and adjacent Y-axis partial coils (21Y) are housed.

13 Claims, 3 Drawing Sheets

(51) Int. Cl.

| | |
|---|---|
| ***H01Q 7/06*** | (2006.01) |
| *H01Q 1/40* | (2006.01) |
| *H01F 3/00* | (2006.01) |

(56) References Cited

U.S. PATENT DOCUMENTS

| | | | | |
|---|---|---|---|---|
| 9,647,340 | B2 * | 5/2017 | Yagi | H01Q 7/06 |
| 2013/0033408 | A1 * | 2/2013 | Miki | H01Q 1/3241 343/788 |

FOREIGN PATENT DOCUMENTS

| | | |
|---|---|---|
| ES | 2200652 | 3/2004 |
| WO | 2014072075 | 5/2014 |

* cited by examiner

THREE-AXIS ANTENNA WITH IMPROVED QUALITY FACTOR

RELATED APPLICATION

This application is related to and claims priority to European Patent application No. 17382468.1 entitled Three-Axis Antenna with Improved Quality Factor, filed 18 Jul. 2017, the contents of which are hereby incorporated by reference as if set forth in their entirety.

TECHNICAL FIELD

The present invention is directed to a three-axis antenna including a magnetic core surrounded by three orthogonal coils wound in the X-axis, Y-axis and Z-axis directions crossing each other, which allow emitting and receiving a signal to/from any direction, and adapted to operate at a low frequency as a transmitting or receiving antenna.

The antenna is characterized in that having a high gain by an increase of the Q factor (quality factor) of the X, Y and Z-axis obtained by a reduction of the total equivalent parasitic capacity (interlayer and interwinding).

The quality factor is a dimensionless parameter that determines the ratio existing between the energy stored in an antenna (an oscillating resonator) regarding to the energy dissipated per cycle by damping processes. A high-quality factor antenna dissipates less energy per cycle than a low-quality factor antenna.

BACKGROUND

In FIGS. 10a and 10b of U.S. Pat. No. 5,966,641 (PLANTRONICS), there are shown top and side plan views, respectively; of a twin-axis magnetic inductive aerial that includes a permeable core 1002 and first and second windings 1004 and 1006. The core 1002 is box shaped and formed of ferrite. The first winding 1004 is disposed on the surface of the core 1002 in a first plane. The second winding 1006 is disposed in a second plane perpendicular to the first plane. The windings 1004 and 1006 are oriented to minimize mutual inductance. The physical construction of the windings 1004 and 1006 provide this minimization which negates any need for additional mechanical fixing or adjustment, for nulling. In most applications, such a structure is therefore described as self-nulling. The dimensions of the core 1002 are selected so that the windings 1004 and 1006 have substantially identical inductance and capacitance.

U.S. Pat. No. 6,407,677 (VALEO) discloses a device for low-frequency communication by magnetic coupling, comprising an emitter placed in a vehicle and a receiver placed in an identification member, wherein one of the emitter or the receiver includes a loop antenna, the other of the emitter or the receiver includes three associated coils wound around three perpendicular axes defining a trihedral and creating an omnidirectional magnetic field, and the three associated coils are supplied with currents of like frequency, 60 degrees or 120 degrees out of phase relative to each other. The here associated coils are wind on one another around six faces of a parallelepiped, common magnetic core.

ES 2200652 (PREDAN) discloses a three-dimensional hybrid antenna comprising a rectangular shaped monolithic magnetic core, with three mutually orthogonal windings arranged so that the antenna receives a signal in each of the windings when is subjected to a low frequency electromagnetic field. Furthermore, the magnetic core is adhesively bonded to a plastic base, being said plastic base provided with terminals on its bottom side for interconnection between the windings arranged surrounding the core and external systems.

WO 2014072075 (PREMO) discloses a three-dimensional antenna with a magnetic core and three windings 21, 22 and 23 wound around three mutually orthogonal axes, each of said windings surrounding said core 10 and relate to arrangements of windings on a magnetic core and their connections between the windings core and a PCB acting as a support plate.

As known in the art, for a given inductance having a fixed number of turns N, a given form of a core on which is wound, a fixed operating frequency and a known permeability magnetic material with a winding of a given section length and electrical resistivity, the lower the total capacity distributed the greater will be the value of Q.

In high frequencies coils it is necessary that they do not enter in auto resonance at frequencies close to the frequency of operation. To solve this a usual practice has been to design coils having a resonance frequency one order of magnitude above the frequency of operation. For this the values of the inductive and capacitive impedance are calculated to be equal in magnitude and opposite in angle to the auto-resonance frequency. In order to be able to work at high operating frequencies in radio and television systems, medium wave coils, and RF tuned pots, it is a usual practice from the 1950s to the 1970s to use multi-section coil-formers on which the winding is coiled by splitting it to reduce the distributed capacity and so raising the Q factor so that the resonance frequency being maximum.

An example of this technique can be found on EP2360704B1 (SUMIDA) that relates to an antenna coil with a cross shaped core and at least three series windings per branch to reduce de distributed capacity and increase the resonance frequency and the Q-factor.

Document U.S. Pat. No. 9,647,340B2 (TOKO) describes a tri-axial antenna having a magnetic core defining X-axis, Y-axis and Z-axis, said antenna including an X-axis coil wound around the X-axis, a Y-axis coil wound around the Y-axis, and a Z-axis coil wound around the Z-axis. According to this document each coil includes two parallel and symmetric partial coils.

The magnetic core described in this document has four protuberances on the four corners defining two orthogonal winding channels for containing the X-axis coil and for containing the Y-axis coil, but the outer perimeter of the magnetic core lacking winding channel for containing the Z-axis coil.

The magnetic core is inserted within a support structure which defines two parallel winding channels for containing the Z-axis symmetric partial coils. Said support structure is also partially interposed between the X-axis coil and the magnetic core, and also between the Y-axis coil and the magnetic core, said support structure including partition walls spacing apart the symmetric partial coils.

Said support structure spaces the coils from the magnetic core, but produces an increase of the coil length, and introduces parasitic capacities reducing the quality factor of the antenna.

The present invention has been made in view of providing an alternative solution to the ones existent in the art to obtain a three-axis antenna with a high gain by an increase of the Q factor based on a special core on which the three orthogonal coils are directly wind and at least two of said coils being separated by partitions walls of the own core. The proposed solution also provides miniaturization and space saving.

SUMMARY

The present invention concerns a three-axis antenna for emitting and receiving a signal to/from any direction said antenna having an improved quality factor.

The quality factor determines the ratio existing between the energy stored in an oscillating resonator, as an inductor antenna, regarding to the energy dissipated per cycle by damping processes.

The aim of the invention is obtaining a high-quality factor antenna which dissipates less energy per cycle than the previously known lower quality factor antennas.

The invention comprises, as known per the state of the art:

a magnetic core having a prismatic configuration defining an X-axis, a Y-axis, and a Z-axis orthogonal to one another, said prismatic configuration including protuberances protruding on the Z-axis direction on each corner of the magnetic core, said protuberances delimiting an X-axis winding channel and a Y-axis winding channel around the magnetic core;

an X-axis coil wound around the X-axis surrounding the magnetic core within the X-axis winding channel, said X-axis coil comprising two separate and adjacent X-axis partial coils;

a Y-axis coil wound around the Y-axis surrounding the magnetic core within the Y-axis winding channel, said Y-axis coil comprising two separate and adjacent Y-axis partial coils;

a Z-axis coil wound around the Z-axis surrounding the magnetic core, wherein the X-axis winding channel intersects the Y-axis winding channel on two opposed intersection areas in which the Y-axis winding channel is interrupted by the X-axis winding channel defined at a lower level.

Said protuberances protrude in the Z-axis direction preferably on both opposed sides of the magnetic core, and are spaced apart to each other defining a space there between confined between the lateral surfaces of the protuberances facing each other. Said space is a winding channel where a coil can be wound around the magnetic core and retained in that position by said protuberances.

Where both X-axis and Y-axis winding channels are intersected, the X-axis winding channel is at a lower level than the Y-axis winding channel, interrupting said Y-axis winding channel by an engraving wherein the X-axis coil can be housed without interfering with the Y-axis coil housed in the Y-axis winding channel which rest overlapped to the X-axis coil in said intersection areas. So, the part of the Y-axis winding channel contained between lateral surfaces of the protuberances facing each other is at a different level than the X-axis winding channel, interrupting the Y-axis winding channel by a depressed region containing the X-axis winding channel.

This feature permits first a winding of the X-axis coil, and then a winding of the Y-axis coil passing over the X-axis coil without interfering.

Unlike the state of the art disclosed solutions the present invention provides the following features:

said protuberances are also protruding on the X-axis and on the Y-axis directions defining an outer perimeter around of which there is wind the Z-axis coil without interfering with the X-axis coil and the Y-axis coil, said magnetic core includes at least one X-axis partition wall protruding from the X-axis winding channel dividing the X-axis winding channel in two X-axis partial winding channels wherein the two separate and adjacent X-axis partial coils are housed, said X-axis protruding wall not interfering with the Y-axis winding channel;

said magnetic core includes at least one Y-axis partition wall protruding from the Y-axis winding channel dividing the Y-axis winding channel in two Y-axis partial winding channels wherein the two separate and adjacent Y-axis partial coils are housed.

The protrusion of the protuberances in the X-axis and Y-axis directions defining the outer perimeter of the magnetic core provides a stepped configuration on the perimetral surfaces of the magnetic core, being the outer surfaces the surfaces more distant from the center of the magnetic core and being the other perimetral surfaces less distant from the center placed between the protuberances part of said X-axis winding channel and Y-axis winding channel.

It will be understood that the main surfaces of the magnetic core are those surfaces wherein the X-axis coil and the Y-axis coil cross to each other, perpendiculars to Z-axis, being the perimetral surfaces those surfaces surrounding said main surfaces.

The Z-axis coil wound around said outer surfaces of the magnetic core does not interfere with the X-axis coil and the Y-axis coil, which are housed between the protuberances.

The geometry of the magnetic core allows the winding of the three X, Y and Z-axis coils directly in contact with the magnetic core surface, without requiring any additional structural support. Winding the coils on the magnetic core reduces the longitude of each turn of the coil, and the total longitude of the wire constitutive of said coil. This increases the quality factor of the antenna.

As stated before, each X-axis coil comprises two separate and adjacent X-axis partial coils. The magnetic core includes an X-axis partition wall housed in the X-axis winding channel and protruding from the magnetic core. Said X-axis partition wall define two X-axis partial winding channels parallels to each other, and allows an easy, precise and automatic winding of the two separated X-axis partial coils on the magnetic core.

Equivalent partition walls exist in the Y-axis winding channel, defining two parallel Y-axis partial winding channels parallels to each other.

Each partial coil generates its own magnetic field. The inclusion of two parallel partial coils on each coil generates parallel magnetic fields which prevents the dissipation of said magnetic fields, reducing energy dissipation and therefore increasing the quality factor of the antenna.

The inclusion of said partition walls directly on the magnetic core prevents the use of a non-magnetic support structure for supporting the partition walls which will increase the longitude of the coils and will therefore reduce the quality factor of the antenna (see for example the support structure used on U.S. Pat. No. 9,647,340B2).

The partition wall can be or one partition wall or preferably multiple coplanar partition walls.

According to an embodiment of the present invention the X-axis partition wall are protruding on the Y-axis direction and/or on the Z-axis direction. The Y-axis partition wall can be also protruding on the X-axis direction and/or on the Z-axis direction.

The X-axis partition wall is preferably a continuous wall which extends around four adjacent faces of the magnetic core. In the intersection areas where the X-axis winding channel crosses with the Y-axis winding channel and/or with the Z-axis winding channel the height of said X-axis partition wall is equal or lower than the stepped configuration bordering between the X-axis winding channel and the other winding channels. This prevents the X-axis partition wall of interfering with the Y-axis coil or the Z-axis coil.

According to an embodiment, the Y-axis partition wall are two independent and symmetric walls, each extending continuously around three adjacent faces of the prismatic core, being said two independent and symmetric walls spaced apart by the X-axis winding channel. In the intersection areas where the Y-axis winding channel crosses with the Z-axis winding channel the height of said Y-axis partition wall is equal or lower than the stepped configuration bordering between the Y-axis winding channel and the Z-axis winding channel, preventing the Y-axis partition wall of interfering with the Z-axis coil.

Preferably the X-axis partition wall and/or the Y-axis partition wall are equidistant from the protuberances, being centered on the correspondent winding channel. This determines that the partial coils are equal and symmetrically located, and that the magnetic fields generated are also symmetric, increasing the quality factor.

The outer perimeter of the magnetic core may include a Z-axis wall protruding in the X-axis and/or the Y-axis directions. This solution permits the creation of a magnetic core producible by means of a cast injected with magnetic material, said magnetic core having a geometry which can be easily unmolded from a two parts cast. This feature permits an easy, cheap, fast and precise manufacture of the magnetic core.

Said Z-axis wall can be placed on the center of the outer perimeter defining two symmetric Z-axis partial winding channels, said partial channels defining together the Z-axis winding channel. In this embodiment, the Z-axis coil wound around the Z-axis will comprise two separate and adjacent Z-axis partial coils each wound in one different Z-axis partial winding channel.

Alternatively, the Z-axis wall can be protruding in a non-centered position of the outer perimeter, being the Z-axis coil wind around the Z-axis on one side of the Z-axis wall which defines one winding limit for said Z-axis coil.

According to an additional embodiment, a Z-axis additional wall is protruding in a non-centered position of the outer perimeter, being said Z-axis additional wall symmetric to the Z-axis wall defining a Z-axis winding channel there between, and being the Z-axis coil housed on said Z-axis winding channel. This solution prevents the movement of the Z-axis coil from its position, but the production of the magnetic core becomes more complicated and expensive, thus said shape cannot be obtained from a two-part cast, requiring a more complex cast or requiring milling operations on the magnetic core to create the Z-axis winding channel.

In an alternative embodiment, the magnetic core could include a plurality of Z axis walls located in non-centered position creating multiple Z-axis winding channels for partial Z coils.

Preferably said magnetic core will be made of a material selected among ferromagnetic material, PBM (polymer-bonded soft magnetic material), pressed and sintered metallic powder.

The prismatic configuration can be a rectangular prismatic configuration having two main faces perpendicular to each of the X-axis, Y-axis and Z-axis.

Between the X-axis, Y-axis and Z-axis coils and the magnetic core there may be a coating of an electric insulant material, preventing the circulation of elevated inducted currents (Eddy currents) and the generation of equivalent resistances in parallel to the coil inductors due the magnetic core electric conductivity, increasing the quality factor of the antenna.

Said electric insulant material will be preferably a chemical vapor deposited polymer, creating an ultra-thin insulant covering of the magnetic core. Said ultra-thin insulant material does not produce an increase of the length of each turn of the coils.

The three-axis antenna can be over-molded with an insulant material, wherein the metallic connection terminals remain embedded therein, being each metallic connection terminals connected to one end of one wire constitutive of one coil, and having each metallic connection terminal a portion non-covered by the insulant material accessible from the outside of the three-axis antenna cover. Said over-molding prevents the movement of the coils from its precise position, preventing manipulations or accidents which will reduce the quality factor and the metallic connection terminals allow an easy and safe connection of the three-axis antenna to a circuit acting the ends of said terminals as a mounting surface pads.

Other features of the invention appear from the following detailed description of an embodiment.

BRIEF DESCRIPTION OF THE DRAWING

The foregoing and other advantages and features will be more fully understood from the following detailed description of an embodiment with reference to the accompanying drawings, to be taken in an illustrative and not limitative, in which.

DETAILED DESCRIPTION

Figure 1:
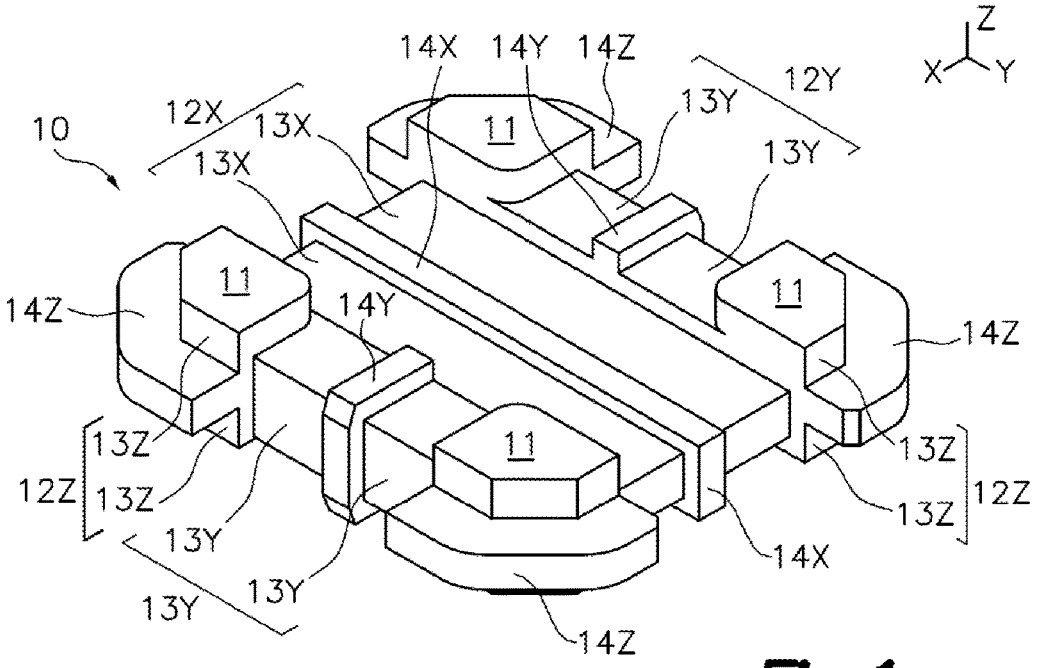
FIG. 1 is a perspective view of a magnetic core according to a first embodiment of the present invention.

The foregoing and other advantages and features will be more fully understood from the following detailed description of an embodiment with reference to the accompanying drawings, to be taken in an illustrative and not limitative, in which:

According to a first embodiment of the three-axis antenna, the magnetic core 10 is obtained from a pressed and sintered metallic powder. Said magnetic core 10 is produced in a two-part cast thanks to its geometry, which permits an easy cast extraction from a two-parts cast. In an alternative embodiment, another material for the core could be use, preferably a ferromagnetic material, PBM (polymer-bonded soft magnetic material). The shape of the magnetic core 10, shown in FIG. 1, is a prismatic configuration defining an X-axis X, a Y-axis Y and a Z-axis Z, orthogonal to each other, and having two main faces perpendiculars to the Z-axis with four corners.

On each corner, a protuberance 11 protrudes from said magnetic core 10, said four protuberances 11 protruding on both main faces of the magnetic core 10, said protuberances 11 extending in radial direction outwards of the prismatic configuration defining an outer perimeter of the magnetic core 10.

On each main face of the magnetic core 10, between the four protuberances 11, two perpendicular winding channels 12X and 12Y are created. The X-axis winding channel 12X crosses both main faces. The space defined between two adjacent protuberances 11 not occupied by the X-axis winding channel 12X includes an elevated surface which creates a stepped configuration with the X-axis winding channel 12X. Said elevated surface defines the Y-axis winding channel 12Y which is in a different height regarding the X-axis winding channel 12X.

The perimetric faces of the magnetic core 10 are those faces which connect the main faces of the magnetic core 10, placed in its perimeter and including the outer perimeter of the magnetic core 10.

As stated before the protuberances 11 protrude in radial directions (X-axis X and Y-axis Y directions). Between the protuberances 11 protruding in radial directions are defined a portion of the X-axis winding channel 12X and of the Y-axis winding channel 12Y, said portions being defined on the perimeter surfaces of the magnetic core 10.

The X-axis winding channel 12X includes, on its center, an X-axis partition wall 14X which, in this embodiment is an annular and continuous wall surrounding the magnetic core 10.

Said X-axis partition wall 14X is a protrusion of the magnetic core 10, and defines two X-axis partial winding channels 13X, one on each side.

The Y-axis winding channel 12Y also includes on its center a Y-axis partition wall 14Y which, in this embodiment, are two independent and coplanar walls each covering three faces of the magnetic core 10, said Y-axis partition wall 14Y being a protrusion of the magnetic core 10 and defining two Y-axis partial winding channels 13Y, one on each side.

The outer perimeter of the magnetic core 10, defined by external surfaces of the protuberances 11, also includes a Z-axis wall 14Z protruding from the magnetic core 10 which, in this embodiment, includes four coplanar walls, one on each protuberance 11, centered on the outer perimeter defining two Z-axis partial winding channels 13Z, one on each side.

Figure 2:
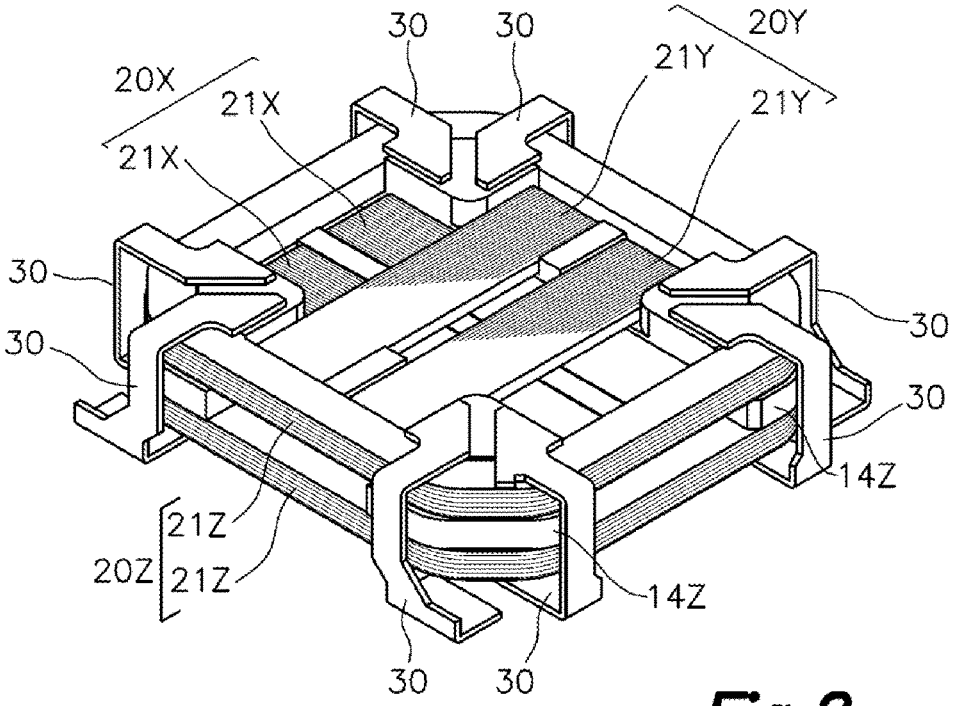
FIG. 2 is a perspective view of the same magnetic core shown on FIG. 1 having X-axis coil, Y-axis coil and Z-axis coil wound therearound, including also metallic connection terminals.

On FIG. 2 it is shown how, on each X-axis partial winding channel 13X, an X-axis partial coil 21X is wound, the two X-axis partial coils 21X creating together an X-axis coil 20X surrounding the magnetic core 10.

Also, on each Y-axis partial winding channel 13Y, a Y-axis partial coil 21Y is wound, the two Y-axis partial coils 21Y creating together a Y-axis coil 20Y surrounding the magnetic core 10.

Finally, on each Z-axis partial winding channel 13Z, a Z-axis partial coil 21Z is wound, the two Z-axis partial coils 21Z creating together a Z-axis coil 20Z surrounding the magnetic core 10.

Then metallic connection terminals 30 are disposed around the three-axis antenna, each metallic connection terminal 30 being connected to one end of a wire constitutive of a partial coil 21X, 21Y, 21Z.

As shown in FIG. 2 each metallic connection terminal 30 is attached to the magnetic core 10 for example by an adhesive on each of the protuberances 11 and provides portions for a surface mounting connection, acting as a surface mounting pads.

Additionally, an over-molded cover will be then created around the three-axis antenna leaving parts of all the metallic connection terminals 30 exposed for the electric connection of the antenna created to a circuit. This over-molded cover has not been indicated in the drawings.

Figure 3:
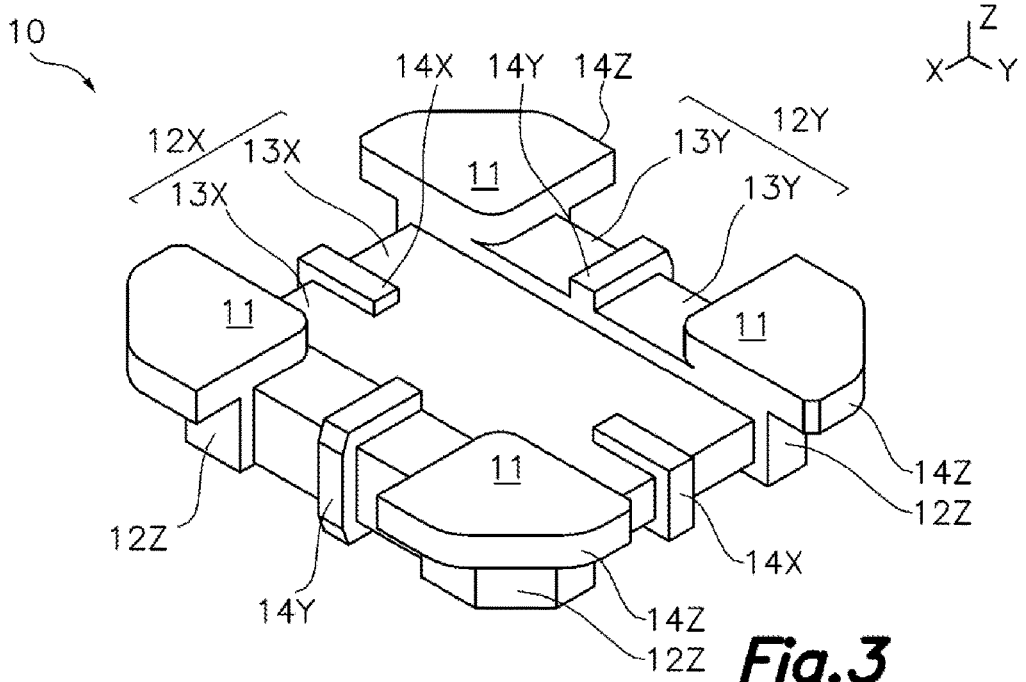
FIG. 3 is a perspective view of a magnetic core according to a second embodiment of the present invention.

According to an alternative embodiment shown in FIG. 3, the X-axis partition wall 14X can be non-continuous and non-annular.

Figure 4:
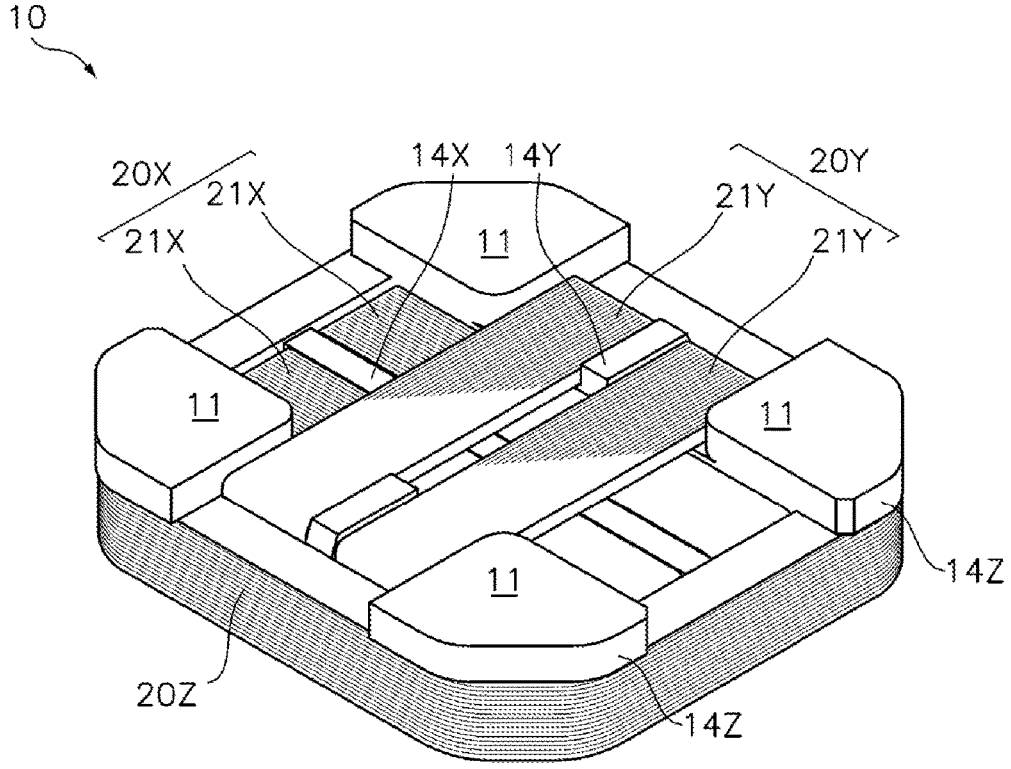
FIG. 4 is a perspective view of the same magnetic core shown on FIG. 3 having X-axis coil, Y-axis coil and Z-axis coil wound therearound.

The Z-axis partition wall 14Z is, in this embodiment, placed on a non-centered position of the outer perimeter, defining a Z-axis winding channel 12Z only on one side thereof, in which a single Z-axis coil 20Z will be wound, as shown in FIG. 4.

Figure 5:
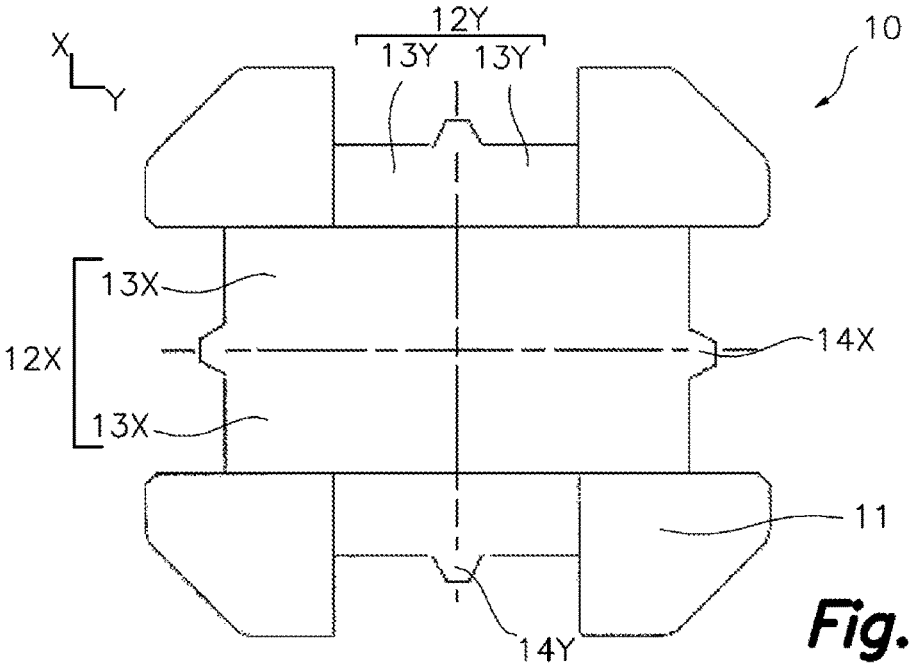
FIG. 5 is a plant view of a magnetic core according to a third embodiment.
Figure 6:
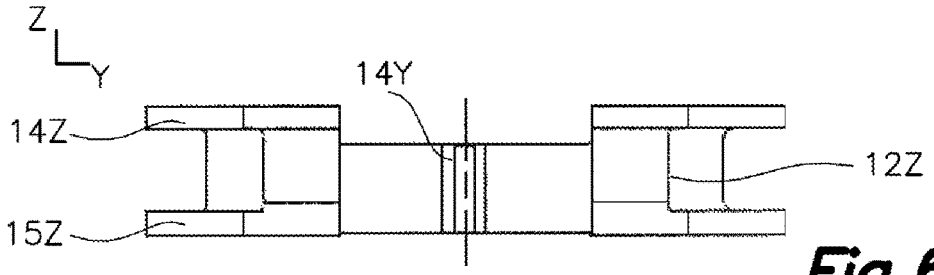
FIG. 6 is a lateral view of the magnetic core shown on FIG. 5.
Figure 7:
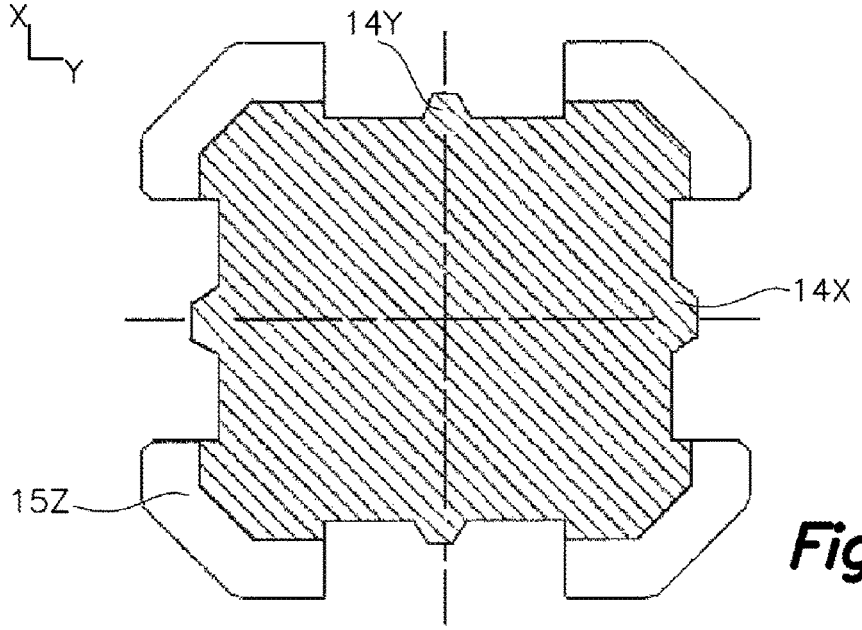
FIG. 7 is a transversal section of the magnetic core shown on FIG. 5 across the Z-axis winding channel.

In an additional alternative shown in FIGS. 5, 6 and 7, the X-axis partition walls 14X are projected only on the Y-axis Y direction, and the Y-axis partition walls 14Y are protruding only on the X-axis X direction, both protruding from the perimeter surfaces of the magnetic core 10 and not from the main faces of the magnetic core 10.

In this embodiment the Z-axis wall 14Z projects from the outer perimeter of the protuberances 11 in a non-centered position, and a Z-axis additional wall 15Z projects also from the outer perimeter in a non-centered position symmetric from the previously mentioned Z-axis wall 14Z regarding a central plan of the magnetic core 10 perpendicular to the Z-axis Z.

Between the Z-axis wall 14Z and the Z-axis additional wall 15Z the Z-axis winding channel 12Z is defined, wherein a single Z-axis coil 20Z will be wound.

The shape of the magnetic core 10 described on this last embodiment cannot be produced in a two parts cast because of the shape of the Z-axis winding channel 12Z contained between two walls facing each other, and because of the shape of the other winding channels 12X and 12Y also contained between faces facing each other on orthogonal directions.

In this case the magnetic core 10 can be produced, for example, by pressing metallic powder in a cast which creates the general shape of the magnetic core 10 lacking the Z-axis winding channel 12Z. Then the magnetic core 10 is extracted and the Z-axis winding channel 12Z is milled in the magnetic core 10 before or after the sintering process which solidifies the metallic powder constitutive of the magnetic core 10. A high-pressure mold injection process and subsequent sintering can be used in an alternative.

In any of the previous embodiments, said magnetic core 10 can be covered with an insulant material previous to winding the X-axis, Y-axis and Z-axis coils 20X, 20Y and 20Z. Preferably said insulant material is a chemical vapor deposited polymer which produces an ultra-thin insulating layer.

It will be understood that various parts of one embodiment of the invention can be freely combined with parts described in other embodiments, even being said combination not explicitly described, provided there is no harm in such combination.

The invention claimed is:

1. A three-axis antenna with an improved quality factor comprising:

a magnetic core (10) having a prismatic configuration defining an X-axis (X), a Y-axis (Y), and a Z-axis (Z) orthogonal to one another, said prismatic configuration being a rectangular prismatic configuration having two main faces perpendicular to each of the X-axis (X), Y-axis (Y) and Z-axis (Z), said prismatic configuration including protuberances (11) protruding on the Z-axis (Z) direction on each corner of the magnetic core (10), said protuberances (11) delimiting an X-axis winding channel (12X) and a Y-axis winding channel (12Y) around the magnetic core (10);

an X-axis coil (20X) wound around the X-axis (X) surrounding the magnetic core (10) within the X-axis winding channel (12X), said X-axis coil (20X) comprising two separate and adjacent X-axis partial coils (21X);

a Y-axis coil (20Y) wound around the Y-axis (Y) surrounding the magnetic core (10) within the Y-axis winding channel (12Y), said Y-axis coil (20Y) comprising two separate and adjacent Y-axis partial coils (21Y);

a Z-axis coil (20Z) wound around the Z-axis (Z) surrounding the magnetic core (10), wherein the X-axis winding channel (12X) intersects the Y-axis winding channel (12Y) on two opposed intersection areas in which the Y-axis winding channel (12Y) is interrupted by the X-axis winding channel (12X) defined at a lower level;

wherein said protuberances (11) are also protruding on the X-axis (X) and on the Y-axis (Y) directions defining an outer perimeter around of which there is wind the Z-axis coil (20Z) without interfering with the X-axis coil (20X) and the Y-axis coil (20Y), said magnetic core (10) includes:

at least one X-axis partition wall (14X) protruding from the X-axis winding channel (12X) dividing the X-axis winding channel (12X) in two X-axis partial winding channels (13X) wherein the two separate and adjacent X-axis partial coils (21X) are housed, said X-axis protruding wall not interfering with the Y-axis winding channel (12Y); and at least one Y-axis partition wall (14Y) protruding from the Y-axis winding channel (12Y) dividing the Y-axis winding channel (12Y) in two Y-axis partial winding channels (13Y) wherein the two separate and adjacent Y-axis partial coils (21Y) are housed;

a Z-axis wall (14Z) included in the outer perimeter of the magnetic core (10) and protruding in the X-axis (X) and/or the Y-axis (Y) directions, providing a magnetic core having an un-moldable geometry easily un-moldable from a two parts cast.

2. The three-axis antenna according to claim 1, wherein the X-axis partition wall (14X) are protruding on the Y-axis (Y) direction and/or on the Z-axis (Z) direction.

3. The three-axis antenna according to claim 1, wherein the Y-axis partition wall (14Y) are protruding on the X-axis (X) direction and/or on the Z-axis (Z) direction.

4. The three-axis antenna according to claim 1, wherein the X-axis partition wall (14X) is a continuous wall which extends around four adjacent faces of the magnetic core (10).

5. The three-axis antenna according to claim 1, wherein the Y-axis partition wall (14Y) are two independent and symmetric walls, each extending continuously around three adjacent faces of the prismatic core (10), being said two independent and symmetric walls spaced apart by the X-axis winding channel (12X).

6. The three-axis antenna according to claim 1 wherein the X-axis partition wall (14X) and/or the Y-axis partition wall (14Y) are equidistant from the protuberances (11).

7. The three-axis antenna according to claim 1 wherein the Z-axis wall (14Z) is placed on the center of the outer perimeter defining two symmetric Z-axis partial wounding channels (13Z) defining together the Z-axis wounding channel (12Z), and wherein the Z-axis coil (20Z) wound around the Z-axis (Z) comprises two separate and adjacent Z-axis partial coils (21Z) each wound in one different Z-axis partial wounding channels (13Z).

8. The three-axis antenna according to claim 1 wherein the Z-axis wall (14Z) is protruding in a non-centered position of the outer perimeter, being the Z-axis coil (20Z) wound around the Z-axis (Z) on one side of the Z-axis wall (14Z) which define one winding limit for said Z-axis coil (20Z).

9. The three-axis antenna according to claim 8 wherein a Z-axis additional wall (15Z) is protruding in a non-centered position of the outer perimeter, being said Z-axis additional wall (15Z) symmetric to the Z-axis wall (14Z) defining a Z-axis winding channel (12Z) there between, and being the Z-axis coil (20Z) housed on said Z-axis winding channel (12Z).

10. The three-axis antenna according to claim 1 wherein said magnetic core (10) is made of a material selected among ferromagnetic material, PBM (polymer-bonded soft magnetic material), pressed and sintered metallic powder.

11. The three-axis antenna according to claim 1 wherein between the X-axis, Y-axis and Z-axis coils (20X, 20Y, 20Z) and the magnetic core (10) there is an electric insulant material.

12. The three-axis antenna according to claim 11 wherein said electric insulant material is a chemical vapor deposited polymer.

13. The three-axis antenna according to claim 1 wherein the three-axis antenna is over-molded with an insulant material, said insulant material including metallic connection terminals (30) embedded therein, being each metallic connection terminals (30) connected to one end of one wire constitutive of one partial coil (21X, 21Y, 21Z), and having each metallic connection terminal (30) a portion non-covered by the insulant material accessible from the outside of the three-axis antenna cover.

* * * * *